US005152439A

United States Patent [19]

Simons

[11] Patent Number: 5,152,439

[45] Date of Patent: Oct. 6, 1992

[54] BOOTJACK ADAPTED FOR VEHICLE BUMPER

[76] Inventor: R. Kaye Simons, 4620 S. Washington Rd., Saginaw, Mich. 48601

[21] Appl. No.: 535,471

[22] Filed: Jun. 8, 1990

[51] Int. Cl.[5] ..... A47G 25/80

[52] U.S. Cl. ..... 223/114; 223/111; 223/113; 293/117

[58] Field of Search ..... 223/114, 111, 113, 115, 223/116, 117; 293/117; D/642

[56] References Cited

U.S. PATENT DOCUMENTS

| | | | |
|---|---|---|---|
| 3,125,368 | 3/1964 | Bonnelly | 293/117 |
| 4,226,346 | 10/1980 | Turner | 223/115 |
| 4,355,744 | 10/1982 | Dudley | 223/115 X |
| 4,394,946 | 7/1983 | McCormick | 223/115 |
| 4,537,337 | 8/1985 | Girty | 223/114 |
| 4,635,833 | 1/1987 | Scarlata | 223/116 |
| 4,760,942 | 8/1988 | Kadar | 223/114 |

*Primary Examiner*—Werner H. Schroeder
*Assistant Examiner*—Bibhu Mohanty
*Attorney, Agent, or Firm*—Robert K. Wallor

[57] ABSTRACT

A unitary planar element is formed to have a generally V-shaped opening in one edge, the opening having a generally rounded bottom, and a channel structure formed along an edge of the planar element obverse to that containing the generally V-shaped opening. The channel structure is configured to removably engage an upper lip edge of a vehicle bumper so as to hold the bootjack at an appropriately canted angle accepting a rear of a heel or achilles region of a boot into the generally V-shaped opening to be held thereby while the leg of the wearer is withdrawn from the boot.

8 Claims, 1 Drawing Sheet

BOOTJACK ADAPTED FOR VEHICLE BUMPER

BACKGROUND OF THE INVENTION

1. Field of the Invention.

This invention relates to devices for assisting in the removal of bootlike footwear, and more particularly to devices adapted to be held in a substantially stationary position while holding or restraining a heel portion of a boot during withdrawal of a leg and foot from that boot.

2. Description of the Prior Art.

Persons who wear boots or similar footwear have long experienced difficulty in grasping the footwear to be removed with sufficient downward pressure and motion to enable such removal in a facile manner, particularly when the wearer is fatigued after extended efforts while wearing such footwear. It is a common practice of long standing for the wearer to seek the assistance of another person to hold the boot during its removal, pulling it away from the wearer while the wearer pulls his or her leg and foot from the boot.

The prior art appears to include many examples of devices conceived to assist a boot wearer in self-removal of such footwear, particularly in the absense of another person to assist the wearer. Most of such prior art devices can be thought of as mechanizations of the simple, but often ineffective, technique of placing the toe of one foot against the rear of the heel portion of the boot to be removed so as to hold that boot in place while the leg and foot therein are withdrawn. Several variations of such mechanizations are of recent origin and shall be briefly discussed in the following.

U.S. Pat. No. 4,226,346, issued Oct. 7, 1980 to TURNER for "Compact Foldable Bootjack with Positive Locking Device" describes the construction of a planar surface accepting a foot thereon to hold the device in place. This planar surface is supported on a leg structure, locked by a bar between the leg and the planar surface, such that the planar surface is at an angle relative to a supporting surface, with the elevated end of the planar surface being formed to include a generally V-shaped opening adapted to accept the rear of the heel portion of the boot therein. Thus, placing the heel of the boot to be removed into the V-shaped opening while stepping on the planar surface with the other foot provides the desired assistance in holding the boot while the leg and foot are withdrawn. Removal of the other boot is accomplished by exchanging the positions of the legs and feet of the wearer. The locking bar and the leg structure are hinged so as to be foldable against the bottom of the planar surface when the device is not in use. The planar surface itself is foldable about a transverse hinge to provide an even more compact stored arrangement of the Turner device.

A very similar device is taught by U.S. Pat. No. 4,355,744, issued Oct. 26, 1982 to DUDLEY for "Portable Bootjack". In this mechanization, the planar platform is formed from rod-like elements with several transverse supports coupled thereto for strength, one end being formed to have a generally U-shaped opening accepting the rear of the heel portion of the boot to be removed. A foldable leg structure is coupled beneath the planar platform frame to pivot about a transverse axis such that, in its opened position, the planar platform is supported from a supporting surface at an angle appropriately elevating the U-shaped opening to engage the heel of the boot being removed.

Yet another similar device is shown by U.S. Pat. No. 4,394,946, issued July 26, 1983 to McCORMICK for "Collapsible Bootjack". In this device, the platform accepting the foot used to hold the device in position rests fully upon the supporting surface. A leg member is pivotably coupled to one end of the platform to extend upwardly therefrom through a distance providing an appropriate elevation for engaging the rear of the heel portion of the boot to be removed. A third member is pivotably coupled to the upper end of the leg member so as to extend substantially horizontally in a direction opposed to the extent of the platform. The distal end of the third member is formed to have a generally U-shaped opening accepting the rear of the heel portion of the boot to be removed. Each of the pivotable couplings is constrained to so limit the relative motions of the several members such that an upward pull on the distal end of the third member, such as would arise when pulling the leg and foot from the boot disposed thereat, will not pivot the distal end of the third member upwardly from its horizontal position, nor is the leg member allowed to pivot backwardly toward the platform. The pivotable couplings are provided to enable the device to be compactly stored by folding the distal end of the third member downwardly through 90 degrees of angle to a position against the leg member and to then fold the leg member in a forward direction through 270 degrees of angle to a position against the bottom surface of the platform.

A non-foldable mechanization is taught by U.S Pat. No. 4,537,337, issued Aug. 27, 1985 to GIRTY for "Boot Removal Apparatus". A platform is provided to be supported at an angle from a supporting surface by a transverse axle and wheel arrangement. The elevated end of the platform holds a generally U shaped frame accepting the rear of the heel portion of the boot to be removed. The wearer steps on the platform with one foot while placing the heel of the other boot into the frame and pulling his or her leg and foot from the boot so held by its heel portion. It would appear that the aesthetic appearance of this device contributes to its uniqueness.

The patent to SCARLATA, U.S. Pat. No. 4,635,833 issued Jan. 13, 1987 for "Portable Bootjack", provides a significant departure from the devices addressed hereinabove in that substantial structure is described. A base frame, resting on a supporting surface, supports a vertical frame from which is pivoted a pedal and a boot heel grasping member. The vertical frame provides a rigidly supported transeverse bar for holding the front of the heel of the boot to be removed. Stepping on the pedal with the other foot, the user causes the pedal to be depressed, which in turn causes the heel grasping member to pivot toward the rigidly supported bar so as to hold the heel of the boot being removed therebetween while the leg and foot are withdrawn. It would appear that the need to exert downward pressure on the pedal requires that the user be in a substantially seated or otherwise supported position so that both legs may be used during the boot removal operation of this device.

As a final example, U.S. Pat. No. 4,760,942, issued Aug. 2, 1988 to KADAR for "Boot Lifter for Elderly and Handicapped" provides that the generally U-shaped structure accepting the rear of the heel portion of the boot to be removed includes means for varying the configuration of the U-shape and that the distal ends or the arms forming the U-shape be spring biased toward each other. The remainder of the Kadar device appears quite similar to the majority of the other devices described hereinabove.

In summary, the principal features that appear to be taught by the prior art are the presence of a generally U-shaped frame accepting the rear of the heel or ankle portion of the boot to be removed, means for supporting the U-shaped frame at an elevation above a supporting surface appropriate for engaging the proper portion of the boot to be removed, and a supporting base or platform upon which the other foot of the wearer is placed to hold the device in position while the boot is removed. The aforesaid devices diverge from these basic principles only in their respective degrees of complexity and auxiliary structural constructions.

SUMMARY OF THE INVENTION

Accordingly, it is an object of the present invention to provide a device useful in assisting a wearer in the self-removal of footwear.

It is another object of the present invention to provide a device for assisting in the removal of footwear that is adapted to be removably supported by a bumper of a vehicle or a similar support It is an additional object of the present invention to provide a device for assisting in the removal of footwear that requires the wearer to employ only the leg bearing the footwear to be removed during its use.

It is a further object of the present invention to provide a device for assisting in the removal of footwear that is constructable as a single, integral member.

Another object of the present invention is to provide a device for assisting in the removal of footwear that is portable, light-weight, and durable.

An additional object of the present invention is to provide a device for assisting in the removal of footwear that may be readily manufactured at minimal cost.

A further object of the present invention is to provide a device for assisting in the removal of footwear that is adaptable to the inclusion of aesthetic designs.

Yet another object of the present invention is to provide a device for assisting in the removal of footwear that may be further employed as a temporary support for other devices, tools, or implements.

Yet an additional object of the present invention is to provide a method for removably supporting a device or equipment from an edge of a rigid planar structure.

These, and other objects, advantages, and features of the present invention that may become evident through the descriptions and claims hereinbelow, are provided by bootjack device fabricated as an integral unitary element from a substantially rigid, durable material. To simplify the description of the bootjack element, it is most appropriate to first identify its manner of installation for use. The bootjack element is typically affixed to rest on an upper lip edge of a bumper of a vehicle so as to extend along a portion of the extent of the upper lip edge of the bumper. When observed from in front of the bumper, that is, from a position whereat the bumper extends substantially horizontally from left to right in the view of the observer, the bootjack element has a horizontal extent along the bumper and a vertical extent upwardly from the bumper both sufficient to enable an upwardly directed, generally V-shaped opening to be formed substantially centrally of the horizontal extent of the bootjack element. The configuration of the U-shaped opening is so established as to be capable of accepting and substantially holding the rear of a heel or achilles portion of a boot therein. The boot thus held is generally oriented to be in a toe-up position. The V-shaped opening is further capable of so accepting boots from among a range of sizes.

When observed in a direction along the extent of the vehicle bumper, the bootjack element is configured as a substantially thin plate extending upwardly from the upper surface of the bumper, with a channel formed along the lower edge to extend toward the vehicle, then downwardly around the lip edge of the bumper, and away from the vehicle to a terminus edge parallel with the extent of the bumper at a line between the upper lip edge of the bumper a plane defining the upward extent of the bootjack element above the bumper. The channel so formed may be provided with an inwardly converging dimension to enable affixing the bootjack element to bumpers having differing thickness at their upper lip edge. Additionally, the bootjack element, when so observed along the extent of the bumper to which it is affixed, may be provided with a camber angle toward or away from the vehicle so as to result in positioning and orientation of the so affixed bootjack element that is most comfortable for use by a majority of users.

In use, the bootjack element is first affixed to the upper lip edge of the bumper by placing the extent of the channel of the bootjack element along the desired portion of the extent of the upper lip edge of the bumper and then forcing the channel of the bootjack element to maximally engage the upper lip edge of the bumper along the full extent of the bootjack element. The wearer of footwear to be removed then positions himself or herself appropriately proximate to, and orthogonally away from the bumper and bootjack element such that the leg bearing the boot to be removed may be lifted and the rear of the heel or achilles portion of the boot placed downwardly into the V-shaped opening of the bootjack element. By pulling the elevated leg away from the upper, the boot may be removed The other boot may be removed in a like manner. Upon completion of the use of the bootjack element, it may be removed from engagement with the bumper by forcing the extent of the channel portion of the bootjack element away from the upper lip edge of the bumper.

While not forming an essential feature of the present invention, it is to be noted that the bootjack element, when installed on the vehicle bumper as described above, provides a notch which may be utilized for temporary support of equipment, either by hanging the equipment from one or another of the upwardly extending arms forming the V-shaped opening, or by resting one end of the equipment on the ground so as to extend upwardly through the V-shaped opening.

The method of forming a generally U-shaped channel to engage the upper lip edge of a vehicle bumper is also useful in providing a method for supporting other devices or equipments from such a bumper or from any other substantially rigid horizontal planar structure having an appropriate lip edge. As examples of such use, the generally U-shaped channel may provide a base for a flag stanchion or for a post supporting a cover for the vehicle.

BRIEF DESCRIPTION OF THE DRAWING

In the accompanying drawing, wherein like reference numbers and symbols are used to refer to like elements and features throughout.

DETAILED DESCRIPTION OF THE INVENTION

Figure 1:
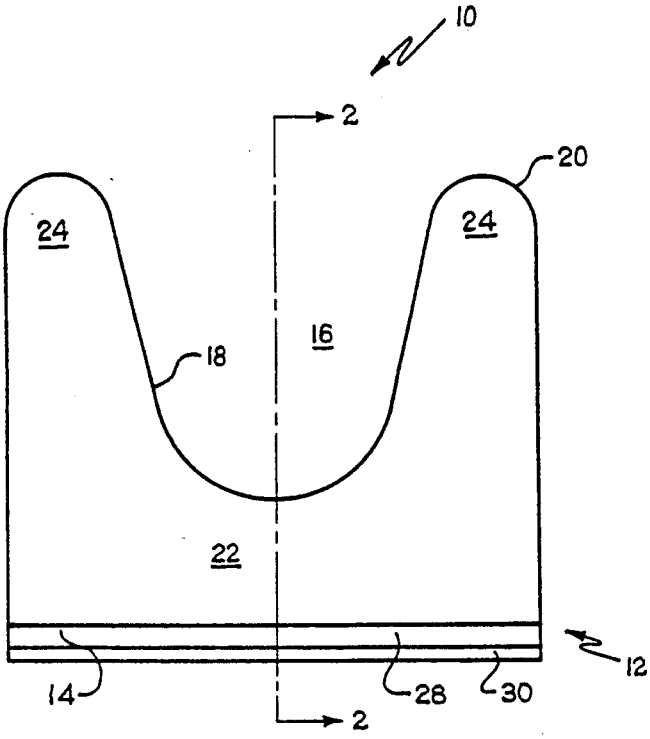
FIG. 1 is a frontal view of a bootjack element in accordance with the present invention.

Referring first to FIG. 1, a bootjack element in accordance with the present invention is indicated generally at 10. The bootjack 10 is seen from its illustrated front to be a unitary element having a generally planar rectangular shape modified by the integral inclusion of a channel forming structure portion 12 extending along the illustrated lower edge 14 of the bootjack 10, and further modified by the formation of a generally V-shaped opening 16, having a substantially rounded bottom central portion 18, extending from an illustrated upper edge 20 of the bootjack 10, obverse to said lower edge 14, toward said lower edge 14. A substantial area 22 is to remain integrally intact between the rounded bottom 18 of the generally V-shaped opening 16 and the lower edge 14 of the bootjack 10. Distal ends 24 of the regions of the bootjack 10 to either side of the generally V-shaped opening 16 are provided with rounded edges to avoid sharp corners or surfaces that may cause injury to a user.

Figure 2:
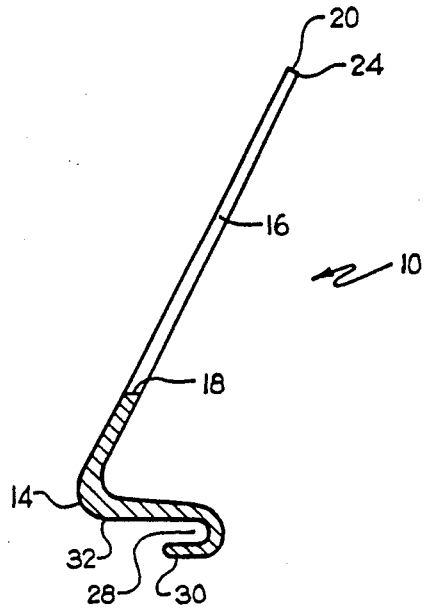
FIG. 2 is a cross-sectional side view of a bootjack element in accordance with the present invention.

Referring next to FIG. 2, the unitarily formed bootjack 10 is shown in a cross-sectional side view relative to the frontal view of FIG. 1 as taken through a plane 2—2 in FIG. 1. As so illustrated, the generally planar portion of the bootjack 10 between its lower edge 14 and the distal ends 24 of the regions to either side of the generally V-shaped opening 16 has a substantially uniform thickness and is canted at an appropriate angle such that the distal ends 24 are disposed inwardly of the plane of FIG. 1. The lower edge 14, extending perpendicularly to the plane of FIG. 2, is integrally formed to merge into the channel forming structure 12. The channel forming structure 12 includes a web portion 26 extending in an illustrated horizontal direction from the lower edge 14 toward the canted direction of the distal ends 24 to a location approaching, but within, a vertical projection of the distal ends 24. A generally U-shaped channel 28 is formed thereat to depend in an illustrated downward direction and thence horizontally toward the lower edge 14. The last mentioned portion, hereinafter identified as a lip-engaging arm 30, has a horizontal extent sufficient for capturing and retaining a horizontally disposed planar element (not illustrated) extending into the plane of FIG. 2. This capture and retention feature will be discussed in greater detail with reference to FIG. 3, hereinbelow.

The web portion 26, the U-shaped channel portion 28, and the lip engaging arm portion 30 each extend into the plane of FIG. 2 for the full extent of the channel structure 12 shown in FIG. 1. The unitarily formed juncture of the web portion 26 with the lower edge 14 is generally formed to be rounded and to have an increased thickness to provide added structural strength accommodating stresses arising during use of the bootjack 10. In such use, a user will have his or her leg positioned such that a rear portion of the heel or achilles portion of a boot is engaged into the V-shaped opening 16, with the leg of the user extending to the illustrated left of FIG. 2. Pulling the leg to the left to cause removal of the boot held by the V shaped opening 16 will tend to cause the distal ends 24 to be pulled to the illustrated left. When the bootjack 10 is installed for use, as will be more fully described later, this pulling action will be resisted by contact between a bearing surface 32 proximate to the lower edge 14 where it meets the web portion 26 and a supporting surface, thus tending to cause the planar portion of the bootjack 10 to bend in the aforesaid thickened region between the web portion 26 and the lower edge 14 so as to increase the angle therebetween. The spacing between inner surfaces of the lip engaging arm 30 and the web portion 26 at the U-shaped channel 28 is defined by a range of thicknesses of vehicle bumper materials, and may be formed to decrease toward the inner portion of the channel 28.

Figure 3:
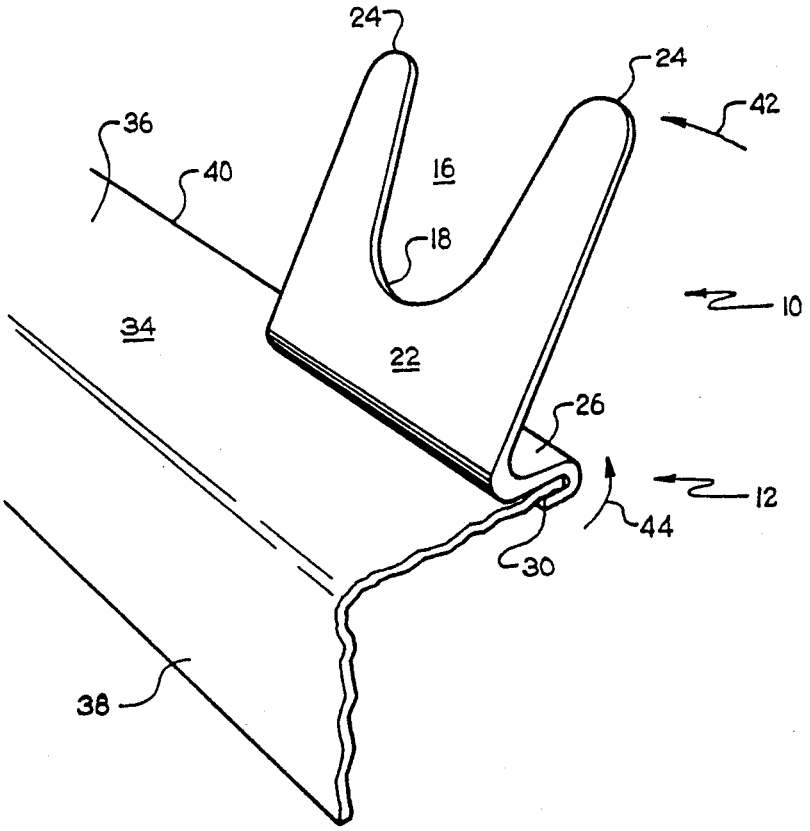
FIG. 3 is a perspective view of the bootjack element in accordance with the present invention, indicating the manner of attachment thereof to a fragmentary portion of a vehicle bumper.

Referring lastly to FIG. 3, installation of the bootjack 10 is shown in perspective with reference to a typical vehicle bumper 34 cut away to illustrate the manner of attachment. The bumper 34 generally includes an upper surface 36 extending across the vehicle and having an appropriate width from a front surface 38 of the bumper 34 to an upper lip edge 40 proximate to the front of the vehicle body (not illustrated). The bootjack 10 is disposed such that its generally U-shaped channel 28 accepts the upper lip edge 40 of the bumper 34 therein along its extent. When the bootjack 10 is so mounted on the bumper 34, the user may position himself or herself to the vehicle front of the position of the bootjack 10, place a first leg upwardly so that a boot thereon will rest in and engage with the generally V-shaped opening 16, with the rear of the heel or achilles portion of the boot proximate to the rounded bottom 18 of the V-shaped opening 16, whereat the user may pull his or her leg away from the vehicle front to remove the boot from that leg. The other boot is removed by exchanging the positions of the legs.

In performing the boot removal operation using the bootjack 10, pull by the user to remove the boot can be seen to tend to cause the distal ends 24 to move in a direction indicated by an arrow 42, which, if the bootjack 10 were not mounted to the bumper 34, would cause the channel forming structure 12 to tend to be rotated about the lower edge 14 in a direction indicated by an arrow 44. Engagement of the U-shaped channel 28 with the upper lip edge 40 of the bumper 34 and contact of the bearing surface 32 of the lower edge 14 of the bootjack 10 with the upper surface 36 of the bumper 34 precludes the latter motion, thus causing the pull on the bootjack 10 to induce stresses along the juncture between the lower edge 14 and the web portion 26, which stresses are accommodated by the increased thickness of the unitarily formed bootjack 10 in that region. Since vehicle bumpers 34 may have a range of material thicknesses, the inner dimensions of the U-shaped channel 28 are established to generally accommodate such a range. When the use of the bootjack 10 has been completed, it may be removed from engagement with the bumper 34 and appropriately stored.

In its disposition of engagement with a bumper 34, the V-shaped opening 16 of the bootjack 10 provides auxiliary utilizations in that equipments may be appropriately engaged with the distal ends 24 or rested in leaning position within the V-shaped opening 16 for temporary support or temporary storage of such equipments.

It is to be noted that, while directed toward the preferred embodiment of a bootjack deployable on a vehicle bumper, the preceding descriptions implicitly provide a method for supporting any similar device or equipment from such a bumper. Indeed, such a method of support, employing a generally U-shaped channel engaging a lip edge of a substantially rigid horizontal lip edge, can engage any such structure, even remote from a vehicle.

While the foregoing descriptions have described a preferred embodiment of a bootjack 10 in accordance with the present invention, it is envisioned that alternate mechanizations and configurations will be evident to those having ordinary skill in the art. Such further embodiments are to be construed as being within the contemplation of the inventor hereof, as limited only by the scope of the appended claims.

I claim:

1. A unitary bootjack comprising:

a substantially rectangular planar portion having a thickness sufficient to provide substantial rigidity, said rectangular planar portion having a length greater than its width;

a generally V-shaped opening through the planar portion from, and including, a first edge of the length of the planar element, said generally V-shaped opening having a rounded bottom of the V-shape disposed proximate to the middle of said width. said opening being so adapted in size and angle of the V-shape as to readily accept and hold a rear portion of a heel or achilles region of a boot therein; and a channel structure integrally formed along a second edge of the length of the planar portion obverse to said first edge, said channel structure being so adapted as to removably engage an upper lip edge of a vehicle bumper structure, whereat said planar portion is supported by said bumper structure to extend generally upwardly therefrom, with said generally V-shaped opening diverging in an upward direction.

2. The unitary bootjack as claimed in claim 1, wherein said channel structure engages said upper lip edge of said bumper structure in a manner such that a pulling force exerted on the periphery of the V-shaped opening directed generally away from the vehicle to which the bumper is attached will tend to cause further engagement of the channel structure of the bootjack with the upper lip edge of the bumper.

3. The unitary bootjack as claimed in claim 2, wherein said channel structure is so integrally formed with respect to said planar portion as to provide that the planar portion is angled toward said vehicle in an upward direction when said channel structure is appropriately engaged with the upper lip edge of the bumper.

4. The unitary bootjack as claimed in claim 3, wherein that portion of the bootjack along, and proximate to, a line along the length of the bootjack forms an imaginary boundary between said planar portion and said channel structure is provided with an increased thickness relative to said thickness of said planar portion.

5. The unitary bootjack as claimed in claim 4, wherein said channel structure is formed to have a web portion extending from said imaginary line along the length of said bootjack to a position whereat an imaginary plane constructed perpendicularly to said web would intersect the planar portion proximate to distal ends of said V-shaped opening, an acute angle being formed between said web and said planar portion, and wherein said channel structure is further formed to have a generally U-shaped channel depending from the web portion so as to have the open end of the U-shape directed from said imaginary plane toward said imaginary line.

6. The unitary bootjack as claimed in claim 1, wherein said first edge of said planar portion is provided with rounded corners to blend into edges of the width of said planar portion, and to blend into distal extents of the angularly diverging sides of the generally V-shaped opening.

7. The unitary bootjack as claimed in claim 1, wherein said bootjack is fabricated from an appropriate resiliently rigid material.

8. The unitary bootjack as claimed in claim 1, wherein said planar portion is provided with an appropriate decorative color or design.

* * * * *